United States Patent [19]

Bereuter

[11] Patent Number: 4,900,034

[45] Date of Patent: Feb. 13, 1990

[54] RANDOM GAMBLING PLAYING PIECES AND LAYOUT AND GAME TABLE FOR USE WITH THE SAME

[76] Inventor: Bernard Bereuter, 1604 - 1155 Beach Avenue, Vancouver, B.C. V6E 1B2, Canada

[21] Appl. No.: 278,132

[22] Filed: Nov. 30, 1988

[51] Int. Cl.[4] ..... A63F 9/04

[52] U.S. Cl. ..... 273/274; 273/146

[58] Field of Search ..... 273/146, 274; D21/41

[56] References Cited

U.S. PATENT DOCUMENTS

| | | | |
|---|---|---|---|
| 3,908,999 | 9/1975 | Brown | 273/146 |
| 4,346,900 | 8/1982 | Lamlee | 273/274 |
| 4,546,978 | 10/1985 | David | 273/146 |
| 4,573,688 | 3/1986 | Grimes | 273/241 |
| 4,632,397 | 12/1986 | Rivkin | 273/145 CA |
| 4,648,602 | 3/1987 | Maroney | 273/146 |
| 4,688,803 | 8/1987 | Ollington | 273/274 |
| 4,807,883 | 2/1989 | Silverman | 273/146 |

*Primary Examiner*—Anton O. Oechsle

*Attorney, Agent, or Firm*—Ward Brown; Robert W. Beach

[57] ABSTRACT

Small pentagonal prisms of regular pentagon cross section have two opposite end faces and five circumferential side faces. The prisms are marked with indicia to indicate uniquely on which of the seven outer faces each of the prisms is resting. The length of the prism, i.e., the distance between the opposite end faces, is selected such that the probability of the playing piece landing on any of its seven outer faces is approximately equal. A layout intended for use with a pair of such pieces has a multiplicity of different betting areas arranged in concentric pentagonal rings; and a gaming table intended for use with such playing pieces is of pentagonal shape having five upright peripheral sides for retaining a pair of playing pieces thrown therein by players.

18 Claims, 4 Drawing Sheets

RANDOM GAMBLING PLAYING PIECES AND LAYOUT AND GAME TABLE FOR USE WITH THE SAME

BACKGROUND OF THE INVENTION

1. Field of the Invention

The present invention relates to the general field of amusement devices and games. More specifically, the present invention relates to random gambling devices and, still more specifically, to dice games and wagering or betting layouts and tables, such as casino dice game apparatus.

2. Prior Art

The well-known game of craps requires only a pair of standard cubical dice, but is more entertaining when played with a large rectangular layout having several spaces for placing bets on a variety of different contingencies. In its most elaborate casino form, the layout is secured over a large game table of a size sufficient for a small crowd to gather around. The game table has a raised peripheral rim for retaining the dice when thrown onto the layout by the designated player or shooter, which results in preferably random rolls of the dice.

Different types of dice game apparatus are disclosed in Ollington U.S. Pat. No. 4,688,803, issued Aug. 25, 1988 (Casino Game Table and Dice) and Maroney U.S. Pat. No. 4,648,602, issued Mar. 10, 1987 (Dice Game Apparatus). Different types of playing pieces intended to be thrown or rolled like dice are disclosed in David U.S. Pat. No. 4,546,978, issued Oct. 15, 1985 (Dice and Games) and Grimes U.S. Pat. No. 4,573,688, issued Mar. 4, 1986 (Gameboard Apparatus With Separating Die). A modified playing piece and closed container for the same is disclosed in Rivkin U.S. Pat. No. 4,632,397, issued Dec. 30, 1986 (Amusement Chance Device).

SUMMARY OF THE INVENTION

It is an object of the present invention to provide a novel playing piece for use in random gambling games.

It also is an object to provide a novel layout with a plurality of spaces or betting areas for different contingencies based on such novel playing pieces.

A further object is to provide novel apparatus adapting such playing pieces and layout for casino use.

Another object is to provide such playing pieces, layout and game apparatus in forms sufficiently familiar so as to be immediately recognizable and easy to use and learn, but sufficiently different and versatile so as to be interesting and amusing.

In accordance with the present invention, the first of the foregoing objects is accomplished by providing a playing piece in the form of a nonrectangular prism having numerical indicia on its opposite end faces and consecutive numerical indicia spaced uniformly around its circumference. Preferably, the transverse section of each playing piece is a regular polygon having an odd number of sides, preferably five, and the circumferential indicia cross the parallel edges connecting the opposite end faces of the prism.

In the preferred embodiment, the prismatic playing piece has two pentagonal opposite end faces and five rectangular side faces around its circumference for a total of seven faces. The length of such pentagonal prism (the distance between the end faces) is selected such that the probability of the playing piece landing on any one of the rectangular circumferential side faces is equal to the probability of it landing on either of its pentagonal end faces. The five circumferential edges between side faces can be identified by numerical indicia from 1 through 5 and the two end faces can be designated 6 and 7, respectively.

The layout intended for use with the preferred playing pieces has a multiplicity of different betting areas contained within a pentagon, preferably a regular pentagon. The pentagonal array has several rings for different categories of bets. For casino use, the layout can be placed over the horizontal top of a gambling table which, in accordance with the present invention, also is of pentagonal shape. The table has a raised rim for containing a pair of playing pieces thrown by the players. The table and layout can be designed such that one side of the pentagon is reserved for access by the house personnel overseeing the game.

DETAILED DESCRIPTION

Figure 1:
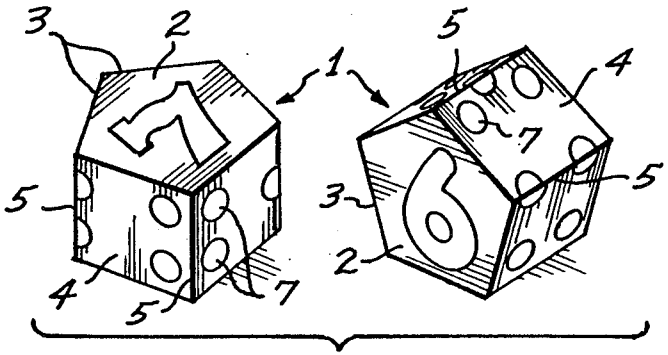
FIG. 1 is a top perspective of a pair of random gambling playing pieces in accordance with the present invention.

With reference to FIG. 1, in the preferred embodiment of the present invention random gambling playing pieces 1 are provided in pairs, each piece of the pair being identical to the other. Each piece is in the form of a pentagonal prism having parallel, planar, opposite end faces 2. Each end face is bounded by five edges 3 or equal length. In FIG. 1, the two playing pieces 1 are oriented with different end faces 2 toward the viewer so that it can be seen that there are different numerical indicia on the opposite end faces. In the illustrated embodiment, one end face is marked with the numeral 6 and the other end face is marked with the numeral 7.

The regular pentagon cross-sectional shape of each playing piece results in five rectangular circumferential side faces 4 and five circumferential linear edges 5 extending between the two opposite end faces 2. In the preferred embodiment, the length of the prism, which is the length of each circumferential edge 5, is selected so that there is equal probability that a playing piece will land on any of its seven outer face. For example, the probability of a playing piece landing on either of its end faces 2, such as indicated for the playing piece at the left in FIG. 1, is equal to the probability of its landing on any of its circumferential side faces 4, such as indicated for the playing piece at the right of FIG. 1.

Using playing pieces formed of hard plastic of a type such as could be used for standard dice, experimentation has shown that the desired random landing of the pieces is achieved if the regular pentagon of cross section fits precisely in a circle 1 inch in diameter (resulting in peripheral edges 3 of a length of 0.588 inch) and the length of the prism is 0.753 inch, for pieces rolled over foam-backed felt stretched over a hard horizontal surface.

Figure 2:
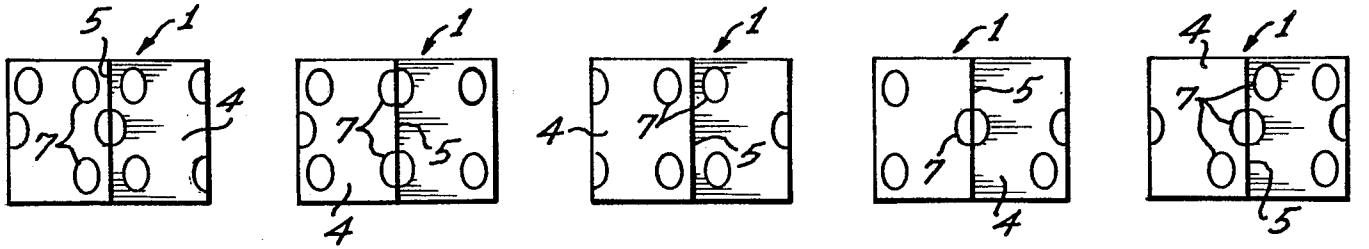
FIG. 2 is a top plan of five such playing pieces oriented with different side edges toward the viewer.

Each playing piece 1 has consecutive numerical indicia marked uniformly around its circumference. With reference to the playing piece shown at the right of FIG. 1, it will be noted that when a playing piece lands on one of the circumferential side faces 4, one of the edges 5 is disposed at the top. Consequently, to designate the different positions of the playing piece when resting on a side face 4, the numerical indicia are designed to cross the edges 5. In the preferred embodiment, the circumferential numerical indicia are circular pips 7 in the familiar arrays for the numbers 1 through 5. FIG. 2 illustrates five of the playing pieces 1 each resting on a different flat face 4. Each piece has been rotated one-fifth revolution relative to each adjacent piece. The order of numbering of the edges 5 does not matter so long as they are numbered differently. In the illustrated embodiment, the edges 5 are numbered consecutively by five pips (two at each side and one at the center of the top edge 5 for the leftmost piece 1 shown in FIG. 2), then two pips, four pips, one pip and three pips, as shown for the other pieces in FIG. 2 proceeding from the left to the right. In each instance, the array of pips is bisected by its respective linear edge 5.

As compared to the standard cubical die having six consecutively numbered flat faces which, ideally, have an equal probability of facing upward to indicate the numbers 1 through 6 randomly, the preferred playing piece of the present invention has seven outer faces with equal probability of the die coming to rest on any of such faces for indicating the numbers 1 through 7 randomly. In addition, two of the numbers are prominently distinguished from the other five by being marked on the pentagonal end faces 2.

Figure 3:
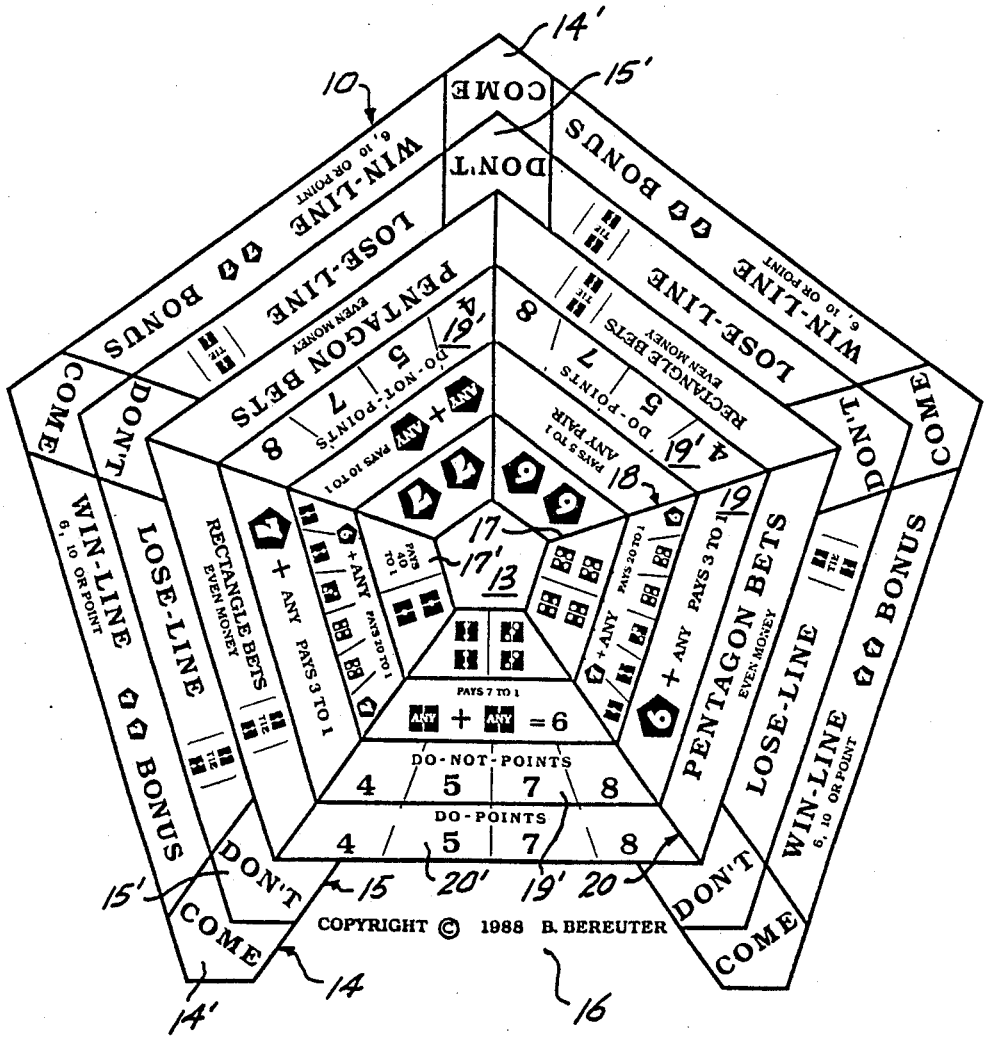
FIG. 3 is a plan of a layout in accordance with the present invention designed for use with the playing pieces of FIG. 1.

Pairs of playing pieces 1 in accordance with the present invention can be used to play a gambling game somewhat similar to craps. FIG. 3 illustrates a layout 10 in accordance with the present invention having a multiplicity of different betting spaces are areas for such game. Preferably, the betting spaces or provided in pentagonal rings, there being several of such rings of separate betting areas increasing in size proceeding outward from the center pentagon 13 of the layout. Each of the outer two rings 14 and 15 extends along only four of the five sides of the pentagon so that the fifth side has an opening 16 which can be used by one or more house overseers for chips, markers, rakes of other game apparatus and for more convenient access to the betting areas to collect losing bets and to pay winning bets.

Each betting area of the layout 10 has graphic indicia for the type of bet selected. The innermost ring 17 has spaces for a first category of one-roll contingencies, namely, the occurrence of identical numbers on the two playing pieces for a selected roll. Consequently, ring 17 has seven betting areas each indicating a different identical pair. A small eighth area 17' indicates the odds paid if the selected pair appears during the selected roll. Otherwise, the bet is lost.

The next outermost ring 18 has five betting areas, one for each of the five sides of the pentagon, for different one-roll contingencies. Beginning with the space at the bottom of ring 18 as viewed in FIG. 3 an proceeding clockwise, a player may be that: both playing pieces will land on rectangular side circumferential faces and the total pipe count for both pieces will be six; or that either of the playing pieces will land with the 6 face up and the other will indicate a selected number; or that both playing pieces will land on pentagonal end faces; or that any of the seven possible identical pairs will appear; or that either of the playing pieces will land with its 7 face up and the other will indicate a selected number.

The next outermost pentagonal ring contains only two one-roll betting areas 19 along two of its five sides, respectively. Such betting areas designate one roll bets for either die landing on a pentagonal face to indicate "6" or "7" regardless of the number indicated by the other die. The other spaces 19' of such ring are used during the multi roll game described below.

The next outermost ring 20 is divided into five areas along its five sides, respectively, including a bottom area 20' used for the multiroll game. Each of the roll four areas designate one of two more one-roll contingencies, namely: "RECTANGLE BETS", paying when both playing pieces land on a rectangular face (except that a combination of 1 and 2 is a tie or push); or "PENTAGON BETS", paying if either or both playing pieces land on a pentagonal end face.

The two outermost rings 14 and 15 encompass four of the five sides of the pentagon, leaving the recess 16 at the bottom. Such outer rings are used for a craps-like multiroll gambling game which uses betting areas labeled "WIN-LINE" and "LOSE-LINE". Preferably, such spaces are provided adjacent to each side of the layout, except the house overseer's recess 16, for convenient access by the players. For the multiroll game, a designated player or shooter rolls the two seven-faced playing pieces. An immediate win for a WIN-LINE bet is achieved if both playing pieces land on a rectangular face and the total pipe count of the top edges is six or ten, or if both playing pieces land 7 side up. An immediate loss results for WIN-LINE bets if both playing pieces land on a rectangular side with a total pip count for top edges of two, three or nine. Other than for the 7, 7 combination and one-roll bets described above, the roll has no significance if either or both playing pieces land on a pentagonal face. The shooter simply rolls again.

If both playing pieces land on a rectangular face and the total pip count is four, five, seven or eight, the player has established a "point" which the house overseer marks in one or more of the spaces 19' and 20'. Similar to the game of craps, the shooter must again roll the same pip count total before rolling a total pip count of six in order to win a WIN-LINE bet. Otherwise, all WIN-LINE bets are lost when the total pip count of six is rolled.

LOSE-LINE bets win when WIN-LINE bets lose and lose when WIN-LINE bets win except that the combination of 1 pip and 2 pips (which constitutes a first roll loss on the WIN-LIN) and the 7, 7 combination (which constitutes a first roll win on the WIN-LINE) are ties or pushes on the LOSE-LINE.

Players may also begin the multiroll betting series other than on the shooters first roll by placing their bets in one of the "COME" betting areas 14' (corresponding to the WIN-LINE betting area) or a "DON'T" area 15' (corresponding to the LOSE-LINE) immediately prior to a selected roll. If a point is established, the COME or DON'T bet is transferred by the house overseer to an appropriate space 19' or 20' until the bet is settled.

The variety of one roll and multiroll bets provides fast, exciting action somewhat similar to the type provided by the conventional game of craps and with a house advantage that can be adjusted by adjusting the odds and the rules, such as rules pertaining to bonuses, pushes and the possibility of backing a multiple-roll bet with a bet paid at true odds after a point has been established.

Figure 4:
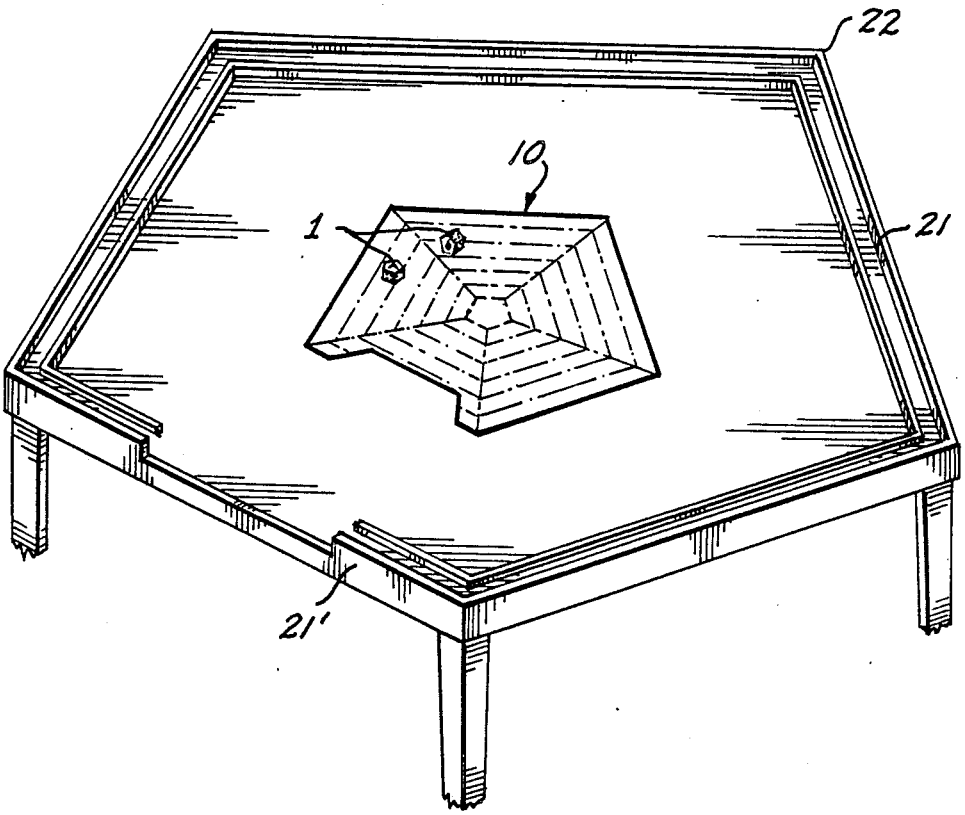
FIG. 4 is a somewhat diagrammatic top perspective of a gambling table in accordance with the present invention designed for use with the playing pieces of FIG. 1 and the layout of FIG. 3.

For a casino game, preferably a table of the type shown diagrammatically in FIG. 4 will be used. Such table is in pentagonal form, four sides 21 of the pentagon being adapted for players and a fifth side 21' being adapted for one or more house overseers. The apex 22 across from the house side 21' also can be configured for use by a house stickman. The table can have a pentagonal layout 10 of the type shown in FIG. 3 and upright peripheral sides for retaining the playing pieces thrown by the players. Chip racks, shelves, etc. for the convenience of the players can be incorporated in the upright sides. Preferably, each of the players' sides 21 will accommodate at least three or four players for a reasonably compact and intimate arrangement for enjoyment and, hopefully, increased betting by the players.

Figure 5:
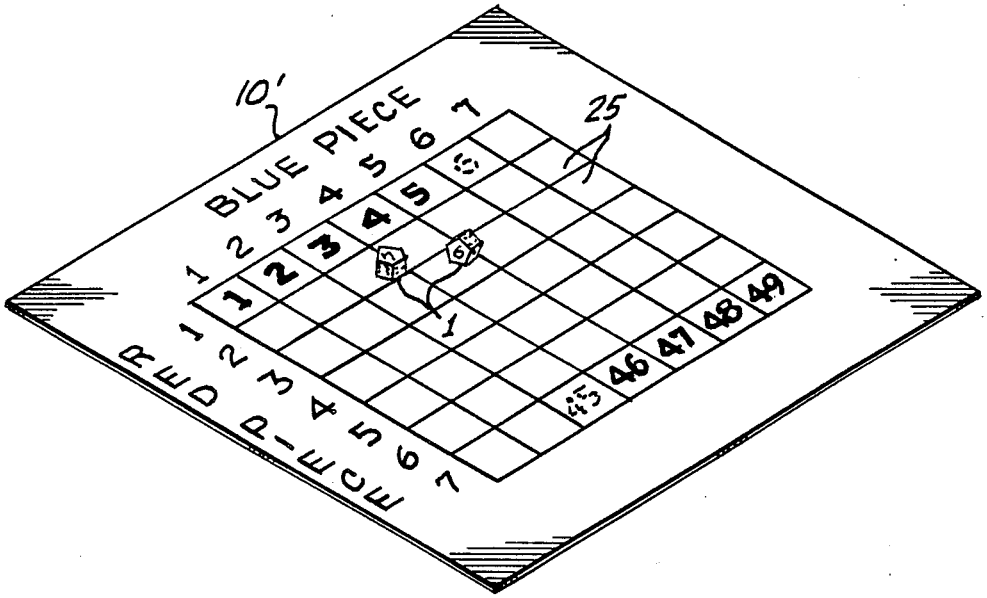
FIG. 5 is a somewhat diagrammatic top perspective of a different layout and random gambling playing pieces in accordance with the present invention.

FIG. 5 illustrates a different layout marked on the exposed top surface of a substrate 10' for use with a pair of the playing pieces 1. As in the previously described embodiment, the pieces 1 are identical except that they are different colors or have different colored or types of indicia. Consequently, the seven indicia of one piece are distinguishable from the seven indicia of the other. The layout of substrate 10' is a square area divided into seven rows labeled for the seven indicia of one of the playing pieces and seven columns labeled for the seven indicia of the other piece. For example, one piece can be red and the other blue. The indicia of the red piece can correspond to columns of the layout and the indicia of the blue piece can correspond to rows as represented in FIG. 5. Preferably each of, the forty-nine separate squares or areas 25 of the array has a unique legend, preferably such legends are consecutive integers from 1 through 49. Each square corresponds to a unique combination of two indicia of the two pieces, respectively. Pieces 1 and layout 10' can be used to play a gambling game similar to roulette, in which case a player bets on one or more of the combinations by placing a bet or bets on the corresponding spaces 25. Another use for the kit of FIG. 5 is to select randomly a series of numbers between 1 and 49, such as to select numbers for a lotto game based on forty-nine numbers, such as the games currently conducted by government agencies in British Columbia and California.

I claim:

1. A random gambling playing piece comprising a nonrectangular prism, the transverse section of said prism being a regular polygon having an odd number of sides such that said prism has nonrectangular end faces joined by rectangular circumferential side faces with adjacent side faces meeting at abrupt longitudinal edges extending between said end faces, said prism having indicia spaced uniformly around its circumference, which indicia cross said abrupt longitudinal edges, respectively.

2. A random gambling playing piece comprising a nonrectangular prism, the transverse section of said prims being a regular polygon having an odd number of sides such that said prism has nonrectangular end faces joined by rectangular circumferential side faces with adjacent side faces meeting at abrupt longitudinal edges extending between said end faces, said prism having indicia spaced uniformly around its circumference which indicia are pips arranged in consecutive numerical arrays, each of said arrays being bisected by one of said abrupt longitudinal edges.

3. A random gambling playing piece comprising a nonrectangular prism, the transverse section of said prims being a regular polygon having an odd number of sides such that said prism has nonrectangular end faces joined by rectangular circumferential side faces with adjacent side faces meeting at abrupt longitudinal edges extending between said end faces, said prims having indicia spaced uniformly around its circumference, the length of said prism being different than the length of a side of the regular polygon transverse section and being equal to the length required so that the probability of said prism landing on either of its end faces is approximately equal to the probability of its landing on any of its side faces.

4. The piece defined in claim 3, in which the length of the prism is greater than the length of a side of the regular polygon transverse section.

5. The piece defined in claim 3, in which the circumference and end faces of the prism are marked with indicia to indicate uniquely on which one of the side and end faces the prism is supported when at rest.

6. A random gambling playing piece comprising a nonrectangular prism, the transverse section of said prism being a regular polygon having an odd number of sides such that said prism has nonrectangular end faces joined by rectangular circumferential side faces with adjacent side faces meeting at abrupt longitudinal edges extending between said end faces, the circumference of said prism being marked with uniformly spaced consecutive numerical indicia beginning with 1 and ending with the integer indicative of the number of side faces of said prism, the opposite end faces of said prism being marked, respectively, with consecutive numerical indicia beginning with the integer following the last integer marked on the circumference.

7. A random gambling playing piece comprising a pentagonal prism of regular pentagon cross section and defining seven planar outer faces, the length of said prism being selected so that the probability of the prism landing on any one of said seven faces is approximately equal to the probability of it landing on any other of said faces, said prism being marked with indicia for the numbers 1 through 7 to indicate uniquely the particular face on which said prism is resting.

8. A gambling kit comprising a pair of random gambling playing pieces, each of said pieces being a pentagonal prism marked with indicia, and a layout including a substrate having separate betting areas for different contingencies of rolls of said prisms.

9. The kit defined in claim 8, in which the playing pieces are identical.

10. The kit defined in claim 8, in which the indicia of one of the playing pieces are distinguishable from the indicia of the other, the layout substrate including a separate betting area for each possible combination of indicia of the two pieces.

11. The kit defined in claim 8, in which the betting areas are arranged in concentric pentagonal rings.

12. A gambling kit comprising a pair of seven-sided rollable playing pieces constructed so that the probability of each piece landing on any side is approximately equal to the probability of such piece landing on any other side, said pieces being marked with indicia to indicate uniquely the particular side on which each piece is resting, the indicia of one piece being distinguishable from the indicia of the other piece, and a layout including a substrate positionable so as to have an exposed surface, said exposed surface having a portion divided into forty-nine separate areas, each of said forty-nine separate areas having a legend corresponding to one and only one combination of indicia of said two pieces, respectively.

13. Gambling apparatus comprising a pair of random gambling playing pieces each identical to the other, each of said pieces being a pentagonal prism of regular pentagon cross section, and a game table having an upper surface including a layout of separate betting areas for different contingencies of rolls of said prisms, said table having raised peripheral sides for retaining said prisms when thrown therein.

14. The apparatus defined in claim 13, in which the separate betting areas of the layout are arranged in concentric pentagonal rings.

15. The apparatus defined in claim 13, in which the game table has five peripheral sides.

16. The apparatus defined in claim 13, in which the length of each prism is selected so that the probability of such prism landing on one of its seven faces is approximately equal to the probability of it landing on any of its other faces.

17. The apparatus defined in claim 16, in which the length of each prism is greater than the length of a side of its regular pentagon cross section.

18. The kit defined in claim 12, in which the legends of the forty-nine separate areas are consecutive integers beginning with 1 and ending with 49.

* * * * *